US005079213A

United States Patent [19]

Chapman et al.

[11] Patent Number: 5,079,213

[45] Date of Patent: Jan. 7, 1992

[54] MAGENTA PYRAZOLYLAZOANILINE DYE-DONOR ELEMENT FOR THERMAL DYE TRANSFER

[75] Inventors: Derek D. Chapman; Steven Evans, both of Rochester, N.Y.

[73] Assignee: Eastman Kodak Company, Rochester, N.Y.

[21] Appl. No.: 676,921

[22] Filed: Mar. 28, 1991

Related U.S. Application Data

[63] Continuation-in-part of Ser. No. 606,402, Oct. 31, 1990, abandoned.

[51] Int. Cl.[5] ..... B41M 5/035; B41M 5/26

[52] U.S. Cl. ..... 503/227; 8/471; 428/195; 428/480; 428/913; 428/914

[58] Field of Search ..... 8/471; 428/195, 480, 428/913, 914; 503/227

[56] References Cited

U.S. PATENT DOCUMENTS 4,764,178 8/1988 Gregory et al. ..... 8/471

*Primary Examiner*—Bruce H. Hess
*Attorney, Agent, or Firm*—Harold E. Cole

[57] ABSTRACT

A dye-donor element for thermal dye transfer comprises a support having thereon a dye dispersed in a polymeric binder, the dye comprising a magenta pyrazolylazoaniline dye having the formula:

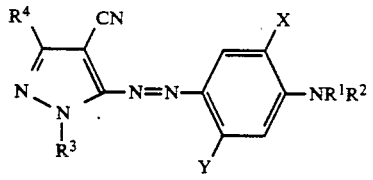

wherein:

$R^1$ and $R^2$ each independently represents hydrogen, a substituted or unsubstituted alkyl group having from 1 to about 6 carbon atoms or an allyl group, with the proviso that $R^1$ and $R^2$ may not both be hydrogen at the same time;

or $R^1$ may be joined together with X to complete a 5- to 6-membered heterocyclic ring;

X represents hydrogen, $R^5$, or $OR^5$, or can be joined together with $R^1$ as described above;

Y represents hydrogen, $R^6$, $OR^6$, halogen, or $NHJR^6$;

J represents —CO—, —$CO_2$—, —$SO_2$—, or —$CONR^4$—;

$R^3$ represents a substituted or unsubstituted alkyl or allyl group as described above for $R^1$ and $R^2$; or a substituted or unsubstituted aryl or hetaryl group of from 5 to about 10 atoms;

each $R^4$ independently represents hydrogen or $R^3$;

$R^5$ represents alkyl, allyl, aryl or hetaryl as described above for $R^3$; and $R^6$ represents alkyl, allyl, aryl or hetaryl as described above for $R^3$;

with the proviso that one of $R^3$, $R^4$, $R^5$ or $R^6$ is an alkyl group of 1 to about 6 carbon atoms substituted with a group capable of intermolecular hydrogen bonding.

20 Claims, No Drawings

MAGENTA PYRAZOLYLAZOANILINE DYE-DONOR ELEMENT FOR THERMAL DYE TRANSFER

This application is a continuation-in-part of application Ser. No. 07/606,402, filed Oct. 31, 1990, now abandoned.

This invention relates to magenta pyrazolylazoaniline dye-donor elements used in thermal dye transfer which have good hue, dye stability and high transfer densities.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue or yield high transfer densities. It would be desirable to provide dyes which have good light stability, have improved hues and give high transfer densities.

U.S. Pat. No. 4,764,178 relates to various dyes including pyrazolylazoanilines used in thermal dye transfer. There is a problem in using these dyes, however, in that they tend to migrate out of the dye-donor upon incubation. It would be desirable to find a way to employ dyes of this class but which would not have this disadvantage.

Substantial improvements in incubation stability, transfer density and hues are achieved in accordance with this invention which comprises a dye-donor element for thermal dye transfer comprising a support having thereon a dye dispersed in a polymeric binder, the dye comprising a magenta pyrazolylazoaniline dye having the formula:

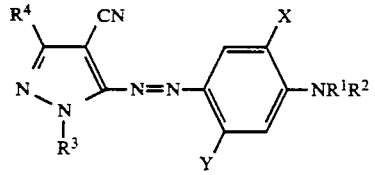

wherein:

$R^1$ and $R^2$ each independently represents hydrogen, an alkyl group having from 1 to about 6 carbon atoms or an allyl group; or such alkyl or allyl groups substituted with one or more groups such as alkyl, aryl, alkoxy, aryloxy, halogen, nitro, cyano, thiocyano, acyloxy, acyl, alkoxycarbonyl, alkoxycarbonyloxy, carbamoyloxy, imido, alkylsulfonyl, arylsulfonyl, alkylthio, arylthio, trifluoromethyl, etc., e.g., methyl, ethyl, propyl, isopropyl, butyl, pentyl, hexyl, methoxyethyl, cyano, methoxycarbonyl, cyclohexyl, cyclopentyl, phenyl, pyridyl, naphthyl, thienyl, pyrazolyl, p-tolyl, p-chlorophenyl, methylthio, butylthio, benzylthio, methanesulfonyl, pentanesulfonyl, methoxy, ethoxy, imidazolyl, naphthyloxy, furyl, p-tolylsulfonyl, p-chlorophenylthio, ethoxy-carbonyl, methoxyethoxycarbonyl, phenoxy-carbonyl, acetyl, benzoyl, N,N-dimethylcarbamoyl, dimethylamino, morpholino, pyrrolidino etc.;

with the proviso that $R^1$ and $R^2$ may not both be hydrogen at the same time;

or $R^1$ may be joined together with X to complete a 5- to 6-membered heterocyclic ring such as dihydrooxazine, dihydropyridine, tetrahydropyridine, etc;

X represents hydrogen, $R^5$, or $OR^5$, or can be joined together with $R^1$ as described above;

Y represents hydrogen, $R^6$, $OR^6$, halogen, or $NHJR^6$;

J represents —CO—, —$CO_2$—, —$SO_2$—, or —$CONR^4$—;

$R^3$ represents a substituted or unsubstituted alkyl or allyl group as described above for $R^1$ and $R^2$; an aryl or hetaryl group of from 5 to about 10 atoms, such as pyridyl, thienyl, phenyl, 2-naphthyl, etc.; or such aryl or hetaryl groups substituted with one or more groups such as are listed above for $R^1$ and $R^2$;

each $R^4$ independently represents hydrogen or $R^3$;

$R^5$ represents alkyl, allyl, aryl or hetaryl as described above for $R^3$; and $R^6$ represents alkyl, allyl, aryl or hetaryl as described above for $R^3$;

with the proviso that one of $R^3$, $R^4$, $R^5$ or $R^6$ is an alkyl group of 1 to about 6 carbon atoms substituted with a group capable of intermolecular hydrogen bonding, such as hydroxyl, methanesulfonamido, acetamido, alkylaminocarbonyl, etc.

The hydrogen bonding groups in the dyes employed according to the invention reduce dye diffusion out of the dye-donor during storage but do not significantly reduce transfer efficiency during thermal printing. Thus, use of the dyes according to this invention enables the production of storage-stable dye-donor elements capable of producing high transfer density. It is believed that hydrogen bonding occurs between the dye molecule and the binder polymer in order to reduce the unwanted dye diffusion.

In a preferred embodiment of the invention, $R^1$ and $R^2$ are each ethyl. In another preferred embodiment, $R^3$ is a hydroxyalkyl group. In yet another preferred embodiment, $R^4$ is t-$C_4H_9$. In yet still another preferred embodiment, X is $OCH_3$. In another preferred embodiment, Y is $NHCOCH_3$.

Compounds included within the scope of the invention include the following:

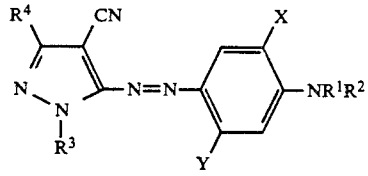

| Cmpd. | $R^1$ | $R^2$ | $R^3$ | $R^4$ | X | Y |
|---|---|---|---|---|---|---|
| 1 | $C_2H_5$ | $C_2H_5$ | $CH_2CHOHCH_3$ | t-$C_4H_9$ | $CH_3O$ | $NHCOCH_3$ |
| 2 | $CH{=}CHCH_2$ | $CH_2{=}CHCH_2$ | $CH_2CHOHCH_3$ | t-$C_4H_9$ | $CH_3O$ | $NHCOCH_3$ |
| 3 | $C_2H_5$ | $C_2H_5$ | $CH_2CHOHCH_3$ | t-$C_4H_9$ | H | $CH_3$ |
| 4 | $C_2H_5$ | $C_2H_5$ | $CH_2CHOHCH_3$ | t-$C_4H_9$ | H | H |
| 5 | $C_2H_5$ | $C_2H_5$ | $CH_3$ | t-$C_4H_9$ | H | $C_2H_4OH$ |
| 6 | $C_2H_5$ | $C_2H_5$ | $CH_3$ | t-$C_4H_9$ | H | $C_2H_4{-}NHCOCH_3$ |
| 7 | $C_2H_5$ | $C_2H_5$ | $CH_3$ | t-$C_4H_9$ | H | $C_2H_4{-}NHSO_2CH_3$ |
| 8 | $C_2H_5$ | $C_2H_5$ | $CH_2CONHCH_3$ | t-$C_4H_9$ | H | $NHCOCH_3$ |
| 9 | $C_2H_5$ | $C_2H_5$ | $CH_3$ | $C_2H_4OH$ | H | $CH_3$ |
| 10 | H | i-$C_3H_7$ | $C_6H_5$ | H | $C_2H_4OH$ | Cl |
| 11 | n-$C_3H_7$ | n-$C_3H_7$ | $C_2H_4Cl$ | $CH_3$ | $CH_3$ | $NHCOCH_2OH$ |
| 12 | $C_6H_5CH_2$ | $C_2H_5$ | $C_2H_4NH{-}SO_2CH_3$ | $C_6H_5$ | $C_2H_5O$ | $NHSO_2CH_3$ |
| 13 | 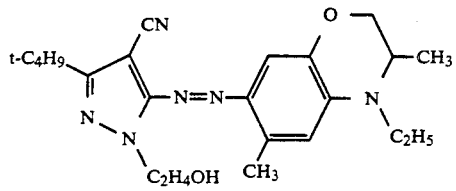 | | | | | |
| 14 | 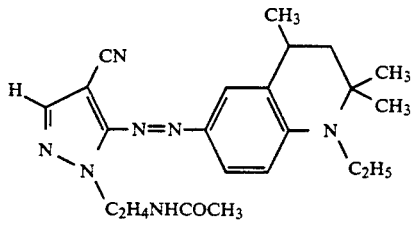 | | | | | |

The above dyes may be prepared analogously to the method described in Example 1 below.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate; poly(styrene-co-acrylonitrile); a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, bayberry wax, candelila wax, carnauba was, ceresine was, Japan wax, montan wax, ouricury wax, rice bran wax, paraffin wax, microcrystalline wax, perfluorinated alkyl ester polyethers, poly(caprolactone), silicone oils, poly(tetrafluoroethylene), carbowaxes, poly(ethylene glycols), or any of those materials disclosed in U.S. Pat. Nos. 4,717,711; 4,717,712; 4,737,485; and 4,738,950, and EP 285,425, page 3, lines 25–35. The waxes may be used in combination with silicone oils as mixtures or the waxes may be used to microencapsulate the silicone oils. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate) The support for the dye-receiving element may also be reflective such as baryta-coated paper, polyethylene-coated paper, an ivory paper, a condenser paper or a synthetic paper such as duPont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly(styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001, a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in DeBoer Application Ser. No. 463,095, filed Jan. 10, 1990, or other materials as described in the following U.S. Application Ser. Nos.: 366,970, 367,062, 366,967, 366,968, 366,969, 367,064, 367,061, 369,494, 366,952, 369,493, 369,492, and 369,491, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. Application Ser. No. 451,656 of Baek and DeBoer, filed Dec. 18, 1989, the disclosure of which is hereby incorporated by reference.

Spacer beads may be employed in a separate layer over the dye layer of the dye-donor in the above-described laser process in order to separate the dye-donor from the dye-receiver during dye transfer, thereby increasing the uniformity and density of the transferred image. That invention is more fully described in U.S. Pat. No. 4,772,582, the disclosure of which is hereby incorporated by reference. Alternatively, the spacer beads may be employed in the receiving layer of the dye-receiver as described in U.S. Pat. No. 4,876,235, the disclosure of which is hereby incorporated by reference. The spacer beads may be coated with a polymeric binder if desired.

A thermal dye transfer assemblage of the invention comprises a) a dye-donor element as described above, and
b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

Example 1 Synthesis of Compound 1 a) Pivaloylmalononitrile intermediate

Pivaloyl chloride (60 g) and malononitrile (33g) were dissolved in methylene chloride (500 ml) and were placed in a flask equipped with a stirrer and a dropping funnel. Triethylamine (100 g) was added slowly with cooling over a period of 45 minutes. The triethylamine hydrochloride was removed and the filtrate was concentrated to about half volume. The solution was poured onto ice, acidified strongly with concentrated hydrochloric acid and the resulting product was filtered off and air dried.

b) 3-Chloro-2-cyano-4,4-dimethyl-2-pentenenitrile intermediate

Phosphorous pentachloride (86 g) was added slowly to a stirred suspension of the above pivaloylmalononitrile intermediate (a) (57 g) in methylene chloride (500 ml) and was allowed to stir at room temperature for 16 hours. Sulfur dioxide was passed through the solution for 20 minutes and the solvent was removed on a rotary evaporator. The residue was poured onto ice and filtered. The product was used without further purification.

c) 5-Amino-4-cyano-3-t-butylpyrazole intermediate

Hydrazine (40 g) was dissolved in ethanol (100 ml) and was placed in a flask equipped with a condenser, a dropping funnel, a thermometer and a magnetic stirrer. A solution of the above pentenenitrile intermediate (b) (80 g) in ethanol (300 ml) was added with stirring at a rate that the temperature did not rise above 35° C. The reaction mixture was then gently refluxed for 90 minutes, the solvent was partially removed and the residue was treated with water. The product was filtered off and dried.

d) 3-Acetamido-4-(3-t-butyl-4-cyano-5-pyrazolylazo)-6-methoxy-N,N-diethylaniline intermediate The above aminopyrazole intermediate (c) (0.8 g) was dissolved in a mixture of concentrated hydrochloric acid (1.5 ml) and water (5 ml) and the solution was cooled to below 5° C. Sodium nitrite (0.35 g) was added in portions with forceful stirring. After 10 minutes acetic acid (5 ml) was added to dissolve the precipitated diazonium salt.

3-Acetamido-2-methoxy-N,N-diethylaniline (1.15 g) was dissolved in aqueous acetic acid (1:1 10 ml) and sodium acetate (5 g) was added. The solution was cooled in ice and the above diazonium solution was added slowly. After 15 minutes the solution was diluted with water and the precipitated dye was filtered off.

e) 4-[3-t-butyl-4-cyano-l-(2-hydroxypropyl)-5-pyrazolylazo]-3-acetamido-6-methoxy-N, N-diethylaniline (Dye 1)

The above pyrazolylazoethylaniline intermediate dye (d) (41 g) was dissolved in acetone (800 ml) and a solution of potassium hydroxide (6 g) in water (100 ml) was added. The mixture was stirred while tetrabutylammonium iodide (2 g) and chloroacetone (10 g) were added. The course of the reaction was followed by thin-layer chromatography (silica gel: ether/ligroin 2:1). After 5 hours, additional potassium hydroxide (2 g) and chloroacetone (2 g) were added and the mixture was allowed to stir overnight. Water (800 ml) was added slowly with stirring at such a rate that the product precipitated in a filterable form. The product was filtered off, washed with 2:1 water/acetone (500 ml) and then dried at 50° C.

The product was added to methanol (800 ml) and stirred vigorously while an excess of sodium borohydride (5 g) was added. There was a slight exotherm and gas evolution occurred. The course of the reaction was followed by thin-layer chromatography. After 2 hours, acetone (20 ml) was added followed by slow addition of water (700 ml). After being cooled the product was filtered off, washed with water and dried.

Example 2—Preparation of Control Dye C-1 ( Similar to Ex. 9 in U.S. Pat. No. 4,764,178

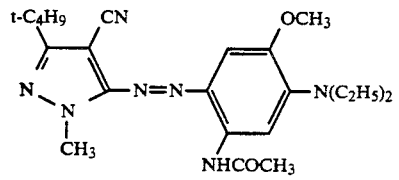

The pyrazolylazoethylaniline intermediate (d) of Example 1 (1.2 g) was dissolved in acetone (5 ml) and potassium hydroxide (0.3 g) in water (3 ml) was added. Dimethyl sulfate (1 ml) was added and the mixture was stirred at room temperature until the methylation was complete by thin-layer chromatography. Dilution with water precipitated the dye.

Example 3

A dye-donor element was prepared by coating on a 100 μm poly(ethylene terephthalate) support:

- a subbing layer of poly(acrylonitrile-co-vinylidene chloride-co-acrylic acid) (0.05 g/m$^2$) (14:79:7 wt. ratio); and
- a dye layer containing the magenta dye 1 illustrated above, (0.39 g/m$^2$), the yellow dye illustrated below, (0.051 g/m$^2$) and the cyanine infrared absorbing dye illustrated below (0.054 g/m$^2$) in a cellulose acetate propionate binder (2.5% acetyl, 45% propionyl) (0.27 g/m$^2$) coated from dichloromethane.

Yellow Dye

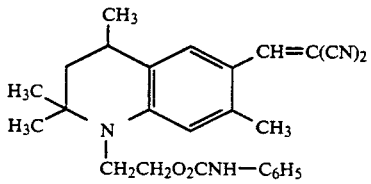

Cyanine Infrared Absorbing Dye

-continued

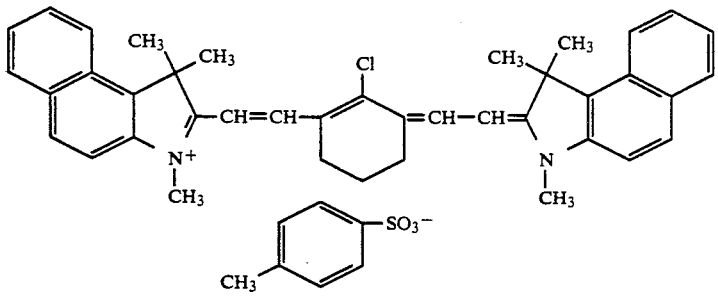

A control dye-donor was prepared as described above except that it contained Control Dye C-1 (Example 2) (0.28 g/m$^2$) and the yellow dye was coated at 0.048 g/m$^2$.

Six sheets of each donor element were stacked together and placed in a bag which was sealed and incubated for four weeks at 49° C., 50% RH. At the end of this time, the bag was opened. In the control dye-donor bag, magenta dye had diffused out of the dye coating onto the back of an adjacent sheet, and in the case of the top sheet, onto the bag surface itself. In the case of the magenta dye which was employed according to the invention, no dye had diffused out of the coating.

In order to measure the amount of dye which had diffused out of the coating in the control element, the following test was run. An area was measured on the back surface of the dye-donor element. The dye which was present on the surface of the measured area was then dissolved in acetone. The amount of dye which had dissolved was then calculated for two separate areas and averaged as follows:

TABLE 1

| Magenta Dye | Amount of Dye Diffused Out of the Coating (g/m$^2$) |
|---|---|
| Compound 1 | 0 |
| Control C-1 | 0.008 (About 3%) |

The above results show that improved incubation stability and less unwanted dye diffusion is obtained using the dye according to the invention in comparison to the control dye.

Example 4

A dye-donor element was prepared by coating on a 100 μm poly(ethylene terephthalate) support:

1) a subbing layer of poly(acrylonitrile-co-vinylidene chloride-co-acrylic acid) (0.05 g/m$^2$) (14:79:7 wt. ratio); and
2) a dye layer containing the magenta dye illustrated below at 0.64 millimoles/m$^2$ and the cyanine infrared absorbing dye of Example 3 (0.054 g/m$^2$) in a cellulose acetate propionate binder (2.5% acetyl, 45% propionyl), in an amount equal to the weight of the magenta dye, coated from dichloromethane.

An intermediate dye-receiving element was prepared by coating on an unsubbed 100 μm thick poly(ethylene terephthalate) support a layer of crosslinked poly(styrene-co-divinylbenzene) beads (14 micron average diameter) (0.11 g/m$^2$), triethanolamine (0.09 g/m$^2$) and DC-510® Silicone Fluid (Dow Corning Company) (0.01 g/m$^2$) in a Butvar® 76 binder, a poly(vinyl alcohol-co-butyral), (Monsanto Company) (4.0 g/m$^2$) from a 1,1,2-trichloroethane and dichloromethane solvent mixture.

Single color stepped images were printed as described below from dye-donors onto a receiver using a laser imaging device as described in U.S. Pat. No. 4,876,235. The laser imaging device consisted of a single diode laser connected to a lens assembly mounted on a translation stage and focused onto the dye-donor layer.

The dye-receiving element was secured to the drum of the diode laser imaging device with the receiving layer facing out. The dye-donor element was secured in face-to-face contact with the receiving element.

The diode laser used was a Spectra Diode Labs No. SDL-2430-H2, having an integral, attached optical fiber for the output of the laser beam, with a wavelength of 816 nm and a nominal power output of 250 milliwatts at the end of the optical fiber. The cleaved face of the optical fiber (100 microns core diameter) was imaged onto the plane of the dye-donor with a 0.33 magnification lens assembly mounted on a translation stage giving a nominal spot size of 33 microns and a measured power output at the focal plane of 115 milliwatts.

The drum, 312 mm in circumference, was rotated at 500 rpm and the imaging electronics were activated. The translation stage was incrementally advanced across the dye-donor by means of a lead screw turned by a microstepping motor, to give a center-to-center line distance of 14 microns (714 lines per centimeter, or 1800 lines per inch). For a continuous tone maximum density image, the current supplied to the laser was not modulated from full power.

After the laser had scanned approximately 12 mm, the laser exposing device was stopped and the receiver was separated from the dye donor. The receiver containing the maximum density dye image was laminated to Ad-Proof Paper® (Appleton Papers Inc.) 60 pound stock paper by passage through a pair of rubber rollers heated to 1120° C. The polyethylene terephthalate support was then peeled away leaving the dye image and polyvinyl alcohol-co-butyral firmly adhered to the paper.

The Status T density of each of the maximum density images was read using an X-Rite® Densitometer and recorded.

In a separate experiment, one sheet of each donor was placed between two sheets of computer paper (Moore Business Forms 9510CJ) and incubated for one week at 49° C., 50% RH. At the end of this time, the interleaved papers were examined It was found that dye had transferred from donors containing control dyes C-1 and C-2 only.

TABLE 2

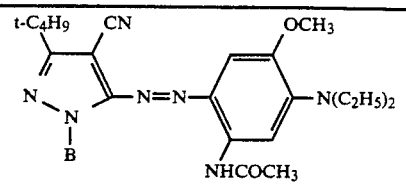

| Magenta Dye | B | Status T Max. Dens. | Dye Diffusion |
|---|---|---|---|
| 1 | $CH_2OHCH_3$ | 1.6 | No |
| C-1 (Control) | $CH_3$ | 1.7 | Yes |
| C-2 (Control) | n-$C_3H_7$ | 1.7 | Yes |
| C-3 (Control) | $CH_2C_6H_5$ | 1.1 | No |

The above results show that use of the dye according to the invention gave good incubation stability with little transferred density decrease in comparison to the controls. While control dye C-3 had less unwanted dye diffusion, it had low transferred dye density, in comparison to the dye employed according to the invention.

Example 5

Dye-donor elements were prepared and tested as in Example 4 using the magenta dyes and controls as shown in Table 3 below.

TABLE 3

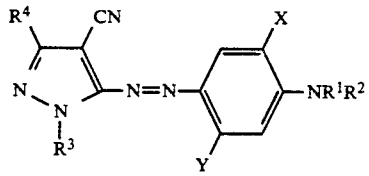

| Cmpd. | $R^1$ | $R^2$ | $R^3$ | $R^4$ | X | Y |
|---|---|---|---|---|---|---|
| 2 | $CH{=}CHCH_2$ | $CH_2{=}CHCH_2$ | $CH_2CHOHCH_3$ | t-$C_4H_9$ | $CH_3O$ | $NHCOCH_3$ |
| C-4 Control | $CH{=}CHCH_2$ | $CH_2{=}CHCH_2$ | $C_3H_7$ | t-$C_4H_9$ | $CH_3O$ | $NHCOCH_3$ |
| 3 | $C_2H_5$ | $C_2H_5$ | $CH_2CHOHCH_3$ | t-$C_4H_9$ | H | $CH_3$ |
| C-5 Control | $C_2H_5$ | $C_2H_5$ | $C_3H_7$ | t-$C_4H_9$ | H | $CH_3$ |
| 4 | $C_2H_5$ | $C_2H_5$ | $CH_2CHOHCH_3$ | t-$C_4H_9$ | H | H |
| C-6 Control | $C_2H_5$ | $C_2H_5$ | $C_3H_7$ | t-$C_4H_9$ | H | H |
| 5 | $C_2H_5$ | $C_2H_5$ | $CH_3$ | t-$C_4H_9$ | H | $C_2H_4OH$ |
| 6 | $C_2H_5$ | $C_2H_5$ | $CH_3$ | t-$C_4H_9$ | H | $C_2H_4{-}NHCOCH_3$ |
| 7 | $C_2H_5$ | $C_2H_5$ | $CH_3$ | t-$C_4H_9$ | H | $C_2H_4{-}NHSO_2CH_3$ |
| C-7 Control | $C_2H_5$ | $C_2H_5$ | $CH_3$ | t-$C_4H_9$ | H | $CH_3$ |
| C-8* Control | $C_2H_5$ | $C_2H_5$ | $C_2H_5$ | $CH_2CN$ | H | $NHCOCH_3$ |

*This is Example 9 from U.S. Pat. No. 4,764,178

One sheet of each donor was placed between two sheets of computer paper (Moore Business Forms 9510CJ) and incubated for 24 hours at 49° C., 50% RH. At the end of that time, the surface of the paper that was in contact with the coated dye side of the dye-donor was examined to evaluate the amount of dye which had transferred. The Status T Blue or Green density was read and corrected for the density of the computer paper itself. The following data were obtained:

TABLE 4

| Dye in Donor | Status T Blue Transferred Density |
|---|---|
| Compound 2 | 0.00* |

TABLE 4-continued

| Dye in Donor | Status T Blue Transferred Density |
|---|---|
| C-4 Control | 0.02* |
| Compound 3 | 0.02 |
| C-5 Control | 0.15 |
| Compound 4 | 0.02 |
| C-6 Control | 0.19 |
| Compound 5 | 0.02 |
| Compound 6 | 0.00 |
| Compound 7 | 0.00 |
| C-7 Control | 0.20 |
| C-8 Control | ** |

*For these dyes, the maximum response was through the Status T green filter
**Although no dye transferred upon incubation of this control dye-donor, it was observed that extensive crystallization had taken place, thus making it unsuitable for a thermal dye transfer product.

The above results show that the dyes of the invention transferred substantially less density than the control dyes.

The invention has been described in detail with particular reference to preferred embodiments thereof, but it will be understood that variations and modifications can be effected with the spirit and scope of the invention.

What is claimed is:

1. A dye-donor element for thermal dye transfer comprising a support having thereon a dye dispersed in a polymeric binder, the dye comprising a magenta pyrazolylazoaniline dye having the formula:

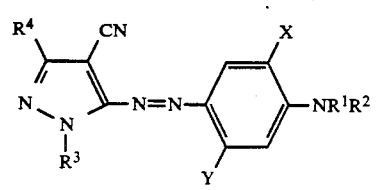

wherein:

$R^1$ and $R^2$ each independently represents hydrogen, a substituted or unsubstituted alkyl group having from 1 to about 6 carbon atoms or an allyl group, with the proviso that $R^1$ and $R^2$ may not both be hydrogen at the same time;

or $R^1$ may be joined together with X to complete a 5- to 6-membered heterocyclic ring;

X represents hydrogen, $R^5$, or $OR^5$, or can be joined together with $R^1$ as described above;

Y represents hydrogen, $R^6$, $OR^6$, halogen, or $NHJR^6$;

J represents —CO—, —$CO_2$—, —$SO_2$—, or —$CONR^4$—;

$R^3$ represents a substituted or unsubstituted alkyl or allyl group as described above for $R^1$ and $R^2$; or a substituted or unsubstituted aryl or hetaryl group of from 5 to about 10 atoms;

each $R^4$ independently represents hydrogen or $R^3$;

$R^5$ represents alkyl, allyl, aryl or hetaryl as described above for $R^3$; and $R^6$ represents alkyl, allyl, aryl or hetaryl as described above for $R^3$;

with the proviso that one of $R^3$, $R^4$, $R^5$ or $R^6$ is an alkyl group of 1 to about 6 carbon atoms substituted with a group capable of intermolecular hydrogen bonding.

2. The element of claim 1 wherein the group capable of intermolecular hydrogen bonding is hydroxyl, methanesulfonamido, acetamido or alkylaminocarbonyl.

3. The element of claim 1 wherein the group capable of intermolecular hydrogen bonding is hydroxyl.

4. The element of claim 1 wherein $R^1$ and $R^2$ are each ethyl.

5. The element of claim 1 wherein $R^3$ is a hydroxyalkyl group and $R^4$ is t-$C_4H_9$.

6. The element of claim 1 wherein X is $OCH_3$ and Y is $NHCOCH_3$.

7. The element of claim 1 wherein said support comprises poly(ethylene terephthalate) and the side of the support opposite the side having thereon said dye layer is coated with a slipping layer a lubricating material.

8. The element of claim 1 wherein said dye layer comprises sequential repeating areas of cyan, yellow and said dye which is of magenta hue.

9. In a process of forming a dye transfer image comprising imagewise-heating a dye-donor element comprising a support having thereon a dye layer comprising a dye dispersed in a polymeric binder and transferring a dye image to a dye-receiving element to form said dye transfer image, the improvement wherein said dye comprises a magenta pyrazolylazoaniline dye having the formula:

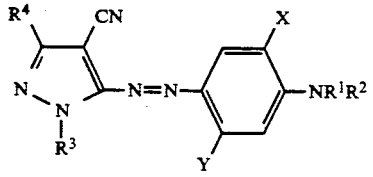

wherein:

$R^1$ and $R^2$ each independently represents hydrogen, a substituted or unsubstituted alkyl group having from 1 to about 6 carbon atoms or an allyl group, with the proviso that $R^1$ and $R^2$ may not both be hydrogen at the same time;

or $R^1$ may be joined together with X to complete a 5- to 6-membered heterocyclic ring;

X represents hydrogen, $R^5$, or $OR^5$, or can be joined together with $R^1$ as described above;

Y represents hydrogen, $R^6$, $OR^6$, halogen, or $NHJR^6$;

J represents —CO—, —$CO_2$—, —$SO_2$—, or —$CONR^4$—;

$R^3$ represents a substituted or unsubstituted alkyl or allyl group as described above for $R^1$ and $R^2$; or a substituted or unsubstituted aryl or hetaryl group of from 5 to about 10 atoms;

each $R^4$ independently represents hydrogen or $R^3$;

$R^5$ represents alkyl, allyl, aryl or hetaryl as described above for $R^3$; and $R^6$ represents alkyl, allyl, aryl or hetaryl as described above for $R^3$;

with the proviso that one of $R^3$, $R^4$, $R^5$ or $R^6$ is an alkyl group of 1 to about 6 carbon atoms substituted with a group capable of intermolecular hydrogen bonding.

10. The process of claim 9 wherein the group capable of intermolecular hydrogen bonding is hydroxyl, methanesulfonamido, acetamido or alkylaminocarbonyl.

11. The process of claim 9 wherein the group capable of intermolecular hydrogen bonding is hydroxyl.

12. The process of claim 9 wherein $R^1$ and $R^2$ are each ethyl.

13. The process of claim 9 wherein $R^3$ is a hydroxyalkyl group and $R^4$ is t-$C_4H_9$.

14. The process of claim 9 wherein X is $OCH_3$ and Y is $NHCOCH_3$.

15. The process of claim 9 wherein said support is poly(ethylene terephthalate) which is coated with sequential repeating areas of magenta, yellow and said dye which is of cyan hue, and said process steps are sequentially performed for each color to obtain a three-color dye transfer image.

16. In a thermal dye transfer assemblage comprising:

a) a dye-donor element comprising a support having thereon a dye layer comprising a dye dispersed in a polymeric binder, and b) a dye-receiving element comprising a support having thereon a dye image-receiving layer, said dye-receiving element being in a superposed relationship with said dye-donor element so that said dye layer is in contact with said dye image-receiving layer, the improvement wherein said dye comprises a magenta pyrazolylazoaniline dye having the formula:

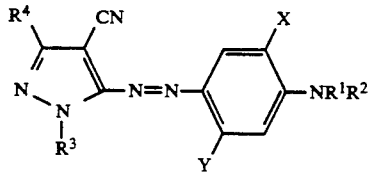

wherein:

$R^1$ and $R^2$ each independently represents hydrogen, a substituted or unsubstituted alkyl group having from 1 to about 6 carbon atoms or an allyl group, with the proviso that $R^1$ and $R^2$ may not both be hydrogen at the same time;

or $R^1$ may be joined together with X to complete a 5- to 6-membered heterocyclic ring;

X represents hydrogen, $R^5$, or $OR^5$, or can be joined together with $R^1$ as described above;

Y represents hydrogen, $R^6$, $OR^6$, halogen, or $NHJR^6$;

J represents —CO—, —$CO_2$—, —$SO_2$—, or —$CONR^4$—;

$R^3$ represents a substituted or unsubstituted alkyl or allyl group as described above for $R^1$ and $R^2$; or a substituted or unsubstituted aryl or hetaryl group of from 5 to about 10 atoms;

each $R^4$ independently represents hydrogen or $R^3$;

$R^5$ represents alkyl, allyl, aryl or hetaryl as described above for $R^3$; and $R^6$ represents alkyl, allyl, aryl or hetaryl as described above for $R^3$;

with the proviso that one of $R^3$, $R^4$, $R^5$ or $R^6$ is an alkyl group of 1 to about 6 carbon atoms substituted with a group capable of intermolecular hydrogen bonding.

17. The assemblage of claim 16 wherein the group capable of intermolecular hydrogen bonding is hydroxyl, methanesulfonamido, acetamido or alkylaminocarbonyl.

18. The assemblage of claim 16 wherein the group capable of intermolecular hydrogen bonding is hydroxyl.

19. The assemblage of claim 16 wherein $R^1$ and $R^2$ are each ethyl and $R^3$ is a hydroxyalkyl group.

20. The assemblage of claim 16 wherein $R^4$ is t-$C_4H_9$, X is $OCH_3$ and Y is $NHCOCH_3$.

* * * * *